US010511102B2

(12) United States Patent
Hirota et al.

(10) Patent No.: US 10,511,102 B2
(45) Date of Patent: Dec. 17, 2019

(54) FEEDER CIRCUIT

(71) Applicant: Mitsubishi Electric Corporation, Chiyoda-ku (JP)

(72) Inventors: Akimichi Hirota, Chiyoda-ku (JP); Naofumi Yoneda, Chiyoda-ku (JP); Shigeo Udagawa, Chiyoda-ku (JP); Mitsuru Kirita, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 56 days.

(21) Appl. No.: 15/568,710

(22) PCT Filed: Jul. 30, 2015

(86) PCT No.: PCT/JP2015/071687
§ 371 (c)(1),
(2) Date: Oct. 23, 2017

(87) PCT Pub. No.: WO2017/017844
PCT Pub. Date: Feb. 2, 2017

(65) Prior Publication Data

US 2018/0145423 A1 May 24, 2018

(51) Int. Cl.
*H01Q 21/30* (2006.01)
*H01P 5/12* (2006.01)
(Continued)

(52) U.S. Cl.
CPC ..... *H01Q 21/30* (2013.01); *H01P 3/082* (2013.01); *H01P 5/12* (2013.01); *H01Q 21/005* (2013.01); *H01Q 21/065* (2013.01)

(58) Field of Classification Search
CPC .. H01Q 21/30; H01Q 21/0006; H01Q 21/005; H01Q 21/0075; H01Q 21/065; H01P 3/026; H01P 3/082; H01P 5/12
(Continued)

(56) References Cited

U.S. PATENT DOCUMENTS 4,652,880 A * 3/1987 Moeller ..... H01Q 3/40 333/128
10,097,218 B2 * 10/2018 Lehtinen ..... H04B 1/0458

FOREIGN PATENT DOCUMENTS

JP 4-805 A 1/1992
JP 4-10703 A 1/1992
(Continued)

OTHER PUBLICATIONS

International Search Report dated Oct. 6, 2015, In PCT/JP2015/071687 filed Jul. 30, 2015.
(Continued)

*Primary Examiner* — Robert J Pascal
*Assistant Examiner* — Kimberly E Glenn
(74) *Attorney, Agent, or Firm* — Oblon, McClelland, Maier & Neustadt, L.L.P.

(57) ABSTRACT

A feeder circuit includes: a first line 103 having first and second ends; a second line 104 having first and second ends; a third line 105 having first and second ends; a first combiner 101 configured to combine signals output from the second ends of the first and second lines 103 and 104; a first coupling portion 115 configured to electrically couple portions of the first and third lines to each other; and a second coupling portion 116 configured to electrically couple portions of the second and third lines to each other in a manner that allows a signal reaching the first combiner from the first end of the third line through the first coupling portion and a signal reaching the first combiner from the first end of the third line through the second coupling portion, to be cancelled out.

6 Claims, 4 Drawing Sheets

(51) Int. Cl.
*H01P 3/08* (2006.01)
*H01Q 21/00* (2006.01)
*H01Q 21/06* (2006.01)

(58) Field of Classification Search
USPC ..... 333/136
See application file for complete search history.

(56) References Cited

FOREIGN PATENT DOCUMENTS

| | | | |
|---|---|---|---|
| JP | 6-152234 | A | 5/1994 |
| JP | 2004-260554 | A | 9/2004 |
| JP | 2009-44207 | A | 2/2009 |
| JP | 2011-142514 | A | 7/2011 |

OTHER PUBLICATIONS

Extended European Search Report dated Mar. 13, 2019 in Patent Application No. 15899677.7, citing document AX therein, 8 pages.
Acimovic, I. et al., "Dual-Polarized Microstrip Patch Planar Array Antennas With Improved Port-to-Port Isolation", IEEE Transactions on Antennas and Propagation, XP011238740, vol. 56, No. 11, Nov. 2008, pp. 3433-3439.

* cited by examiner

FEEDER CIRCUIT

TECHNICAL FIELD

The present invention relates to a feeder circuit for connecting between circuits mainly for VHF bands, UHF bands, micro wave bands, and millimeter wave bands.

BACKGROUND ART

In typical feeder circuits, several types of lines such as microstrip lines and strip lines are used to connect between circuits.

In planar antennas, for example, lines for connecting between a feeding point (an output end) and an array of radiating elements are provided between the feeding point and the radiating elements.

However, in the case where the radiating elements are densely arranged, the lines placed near the radiating elements are close to one another, inducing electrical coupling between the lines which causes deterioration in the radiation pattern and reflection characteristic of the planar antenna.

Patent Literature 1 discloses a technique that includes a dielectric substrate stacked over an aperture plane of a planar antenna, and a polarization grid configured to generate desired polarized waves.

CITATION LIST

Patent Literatures

Patent Literature 1: Japanese Patent Application Publication No. 2011-142514.

SUMMARY OF INVENTION

Technical Problem

However, in a conventional feeder circuit, an arrangement of a polarization grid and a multi-layered structure are necessary to avoid electrical coupling between lines even during polarization control. This causes the problem of an increase in the thickness of a planar antenna as well as an increase in its manufacturing cost.

The present invention has been made to solve such a problem, and an object of the present invention is to provide a feeder circuit with low manufacturing cost which is capable of being less affected from electrical coupling between lines even when the electrical coupling occurs due to the close arrangement of the lines connecting between circuits.

Solution to Problem

The present invention, which has been made to solve the aforementioned problem, provides a feeder circuit which includes: a first line having a first end and a second end; a second line having a first end and a second end; a third line having a first end and a second end; a first combiner connected to the second end of the first line and the second end of the second line, and configured to combine signals output from both the second end of the first line and the second end of the second line; a first coupling portion configured to electrically couple a portion of the first line and a portion of the third line to each other; and a second coupling portion configured to electrically couple a portion of the second line and a portion of the third line to each other in a manner that allows a signal reaching the first combiner from the first end of the third line through the first coupling portion and a signal reaching the first combiner from the first end of the third line through the second coupling portion, to be cancelled out.

Advantageous Effects of Invention

According to the present invention, it is possible to reduce the effect that is possibly caused by electrical coupling occurring between lines that are arranged close to one another in a feeder circuit.

DESCRIPTION OF EMBODIMENTS

First Embodiment

Figure 1:
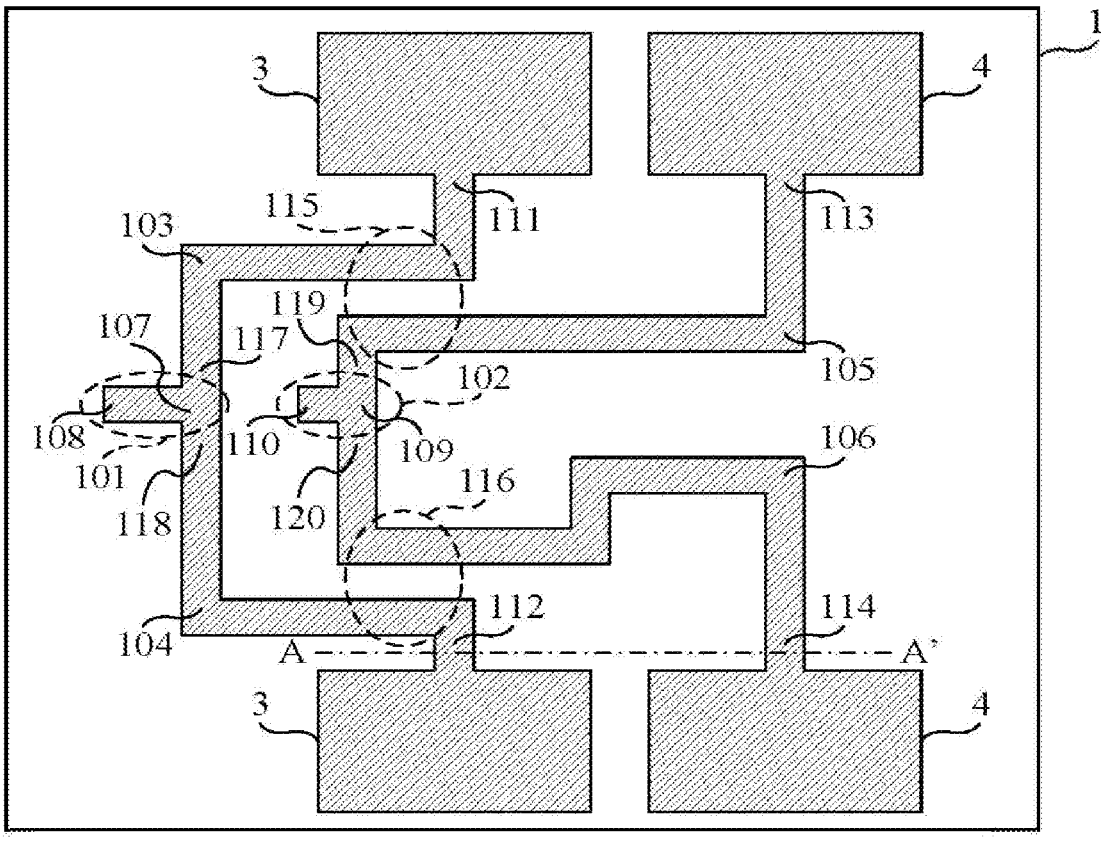
FIG. 1 is a top view of a feeder circuit according to a first embodiment.

Preferred embodiments of the present invention will now be described with reference to the drawings. The same or corresponding component in the drawings will be described using the same reference sign.

Figure 2:
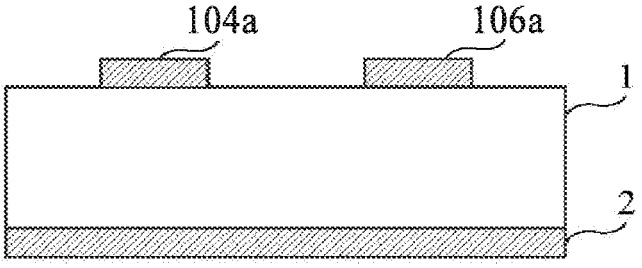
FIG. 2 is a cross-sectional view of the feeder circuit taken along the line A-A' in FIG. 1.

FIG. 1 is a top view of a feeder circuit according to a first embodiment. FIG. 2 is a cross-sectional view of the feeder circuit in FIG. 1 taken along the line A-A'. In FIGS. 1 and 2, the reference sign "1" denotes a dielectric body, "2" denotes a ground plane layer provided on one of the opposite faces of the dielectric substrate, and "104*a*" denotes a second signal conductor. The second signal conductor 104*a*, the dielectric body 1 and the ground plane layer 2 define a second line. The Reference sign "106*a*" denotes a fourth signal conductor. The fourth signal conductor 106*a*, the dielectric body 1, and the ground plane layer 2 define a fourth line 106.

In FIG. 1, the reference signs "3" and "4" denote radiating elements 3 and 4, "101" denotes a first combiner, "102" denotes a second combiner, "103" denotes a first line, "105" denotes a third line, "107" denotes an input end of the first combiner 101, "108" denotes an output end of the first combiner 101, "109" denotes an input end of the second combiner 102, and "110" denotes an output end of the second combiner 102.

In FIG. 1, the reference sign "111" denotes a first end of the first line 103, "112" denotes a first end of the second line 104, "113" denotes a first end of the third line 105, "114" denotes a first end of the fourth line 106, "117" denotes a second end of the first line 103, "118" denotes a second end of the second line 104, "119" denotes a second end of the third line 105, and "120" denotes a second end of the fourth line 106.

The second end 117 of the first line 103 and the second end 118 of the second line 104 are connected to the input end 107 of the first combiner 101.

The second end 119 of the third line 105 and the second end 120 of the fourth line 106 are connected to the input end 109 of the second combiner 102.

The reference sign "115" denotes a first coupling portion in which the first line 103 and the third line 105 are arranged close to each other to be electrically coupled to each other, and "116" denotes a second coupling portion in which the second line 104 and the fourth line 106 are arranged close to each other to be electrically coupled to each other. In this regard, two coupling portions are described in this embodiment, but alternatively, three or more coupling portions may be used. These three or more coupling portions can be provided in a manner that allows their respective couplings to be cancelled out in a combiner, thereby achieving similar effects.

In this embodiment, for ease of explanation, it is assumed that the first coupling portion 115 is a coupling portion, in layout design, indispensable for the formation of the first line 103 and the third line 105 as long as one face of the dielectric body 1 is used. For example, such a restriction is given in the case where, as illustrated in FIG. 1, the combiner 101 is required to be disposed away from the central line of the radiating element 3 and the combiner 102 is required to be disposed away from the central line of the radiating element 4.

In addition, the first combiner 101 is a combiner for in-phase combination which is capable of combining in-phase signals having the same amplitude input to the input end 107 from both the second end 117 of the first line 103 and the second end 118 of the second line 104, without reflection loss. The second combiner 102 is a combiner for in-phase combination which is capable of combining in-phase signals having the same amplitude input to the input end 109 from both the second end 119 of the third line 105 and the second end 120 of the fourth line 106, without reflection loss. The second combiner 102 can be designed like the first combiner 101, or in a different way from the first combiner 101. Alternatively, the second combiner 102 may be omitted.

The radiating element 3 is connected to the first end 111 of the first line 103 and the first end 112 of the second line 104. The radiating element 4 is connected to the first end 113 of the third line 105 and the first end 114 of the fourth line 106.

In this embodiment, the radiating element 3 and the radiating element 4 are patch antennas, although no limitation thereto is intended. Alternatively, the radiating element 3 and the radiating element 4 can be any antennas that are capable of receiving high-frequency signals to allow the combiners 101 and 102 to combine inputs without reflection, for example, patch array antennas and/or helical antennas.

Figure 3:
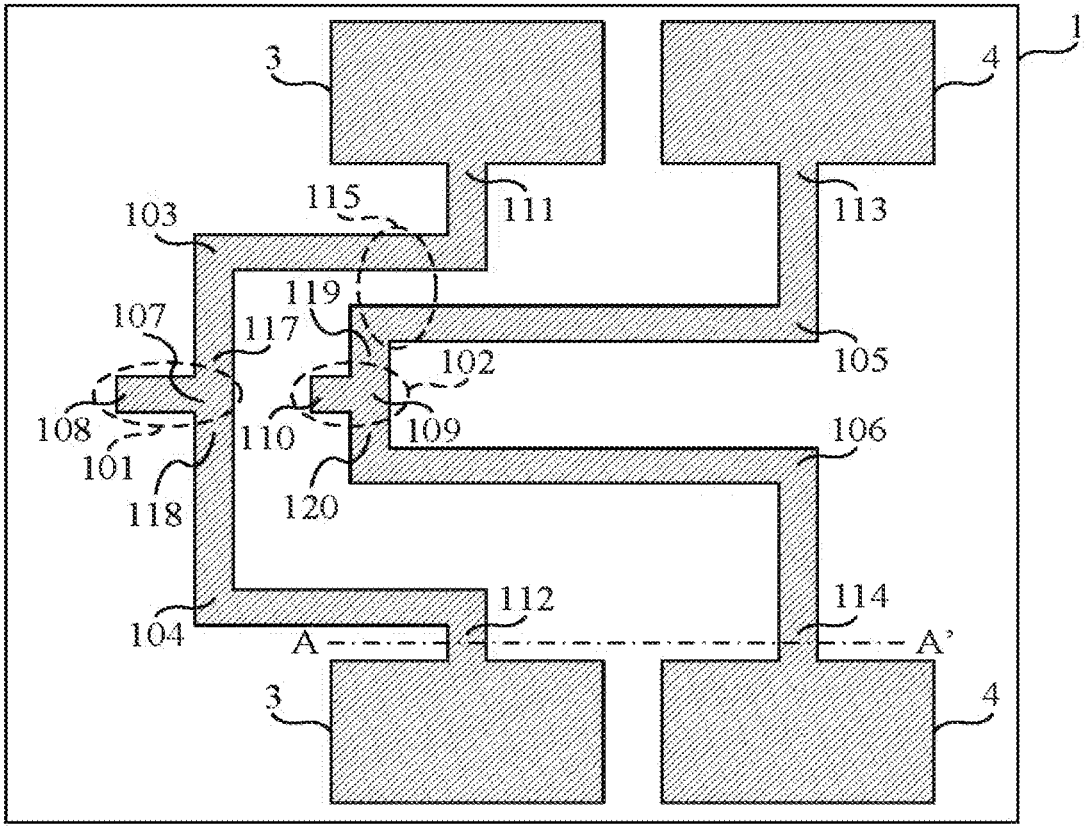
FIG. 3 illustrates a conventional feeder circuit that has an inevitable electrical coupling portion.

In light of the above condition, FIG. 3 is a top view of a conventional feeder circuit having a layout in which the second line 104 and the fourth line 106 can be arranged away from each other to avoid causing electrical coupling between the second and fourth lines 104 and 106, and in which the first line 103 and the third line 105 cannot be arranged away from each other to avoid causing electrical coupling between the first and third lines 103 and 105, thereby producing a first coupling portion 115 between the first and third lines 103 and 105.

Next, the operations of the conventional feeder circuit will now be explained.

In the conventional feeder circuit as illustrated in FIG. 3, two signals, which are received by the radiating elements 3 respectively and will be in-phase with each other at the first combiner 101, are input from the first end 111 of the first line 103 and the first end 112 of the second line 104. Similarly, two signals, which are received by the radiating elements 4 respectively and will be in-phase with each other at the second combiner 102, are input from the first end 113 of the third line 105 and the first end 114 of the fourth line 106.

The radiating elements 3 receive radio waves and output signals indicating the received radio waves to the first end 111 of the first line 103 and the first end 112 of the second line 104.

The first line 103 transmits the signal input to the first end 111, to the second end 117.

The second line 104 transmits the signal input to the first end 112, to the second end 118.

Similarly, the radiating elements 4 receive and converts radio waves into signals, and then output the signals to the first end 113 of the third line 105 and the first end 114 of the fourth line 106.

The third line 105 transmits the signal input to the first end 113, to the second end 119.

The fourth line 106 transmits the signal input to the first end 114, to the second end 120.

In this condition, since the first line 103 and the third line 105 are electrically coupled to each other by the coupling portion 115, part of the signal input from the first end 113 of the third line 105 propagates into the first line 103, and then reaches the first combiner 101 through the second end 117 of the first line 103.

In an ideal situation, the first combiner 101 receives, at the input end 107, only the signals input from the first end 111 of the first line 103 and the first end 112 of the second line 104, combines the received signals, and outputs a composite signal to the output end 108.

However, the first coupling portion 115 as described above causes part of the signal input from the first end 113 of the third line 105 to be coupled to and propagate into the first line 103. The propagating signal reaches the output end 108 through the first combiner 101. In other words, from the output end 108 of the combiner 101, not only the signals input from both the first end 111 of the first line 103 and the first end 112 of the second line 104 are output, and but also the part of the signal input from the first end 113 of the third line 105 is superposed on the signals and is output.

This leads to a disadvantage of deterioration in the reception pattern of only the radiating elements 3.

Figure 4:
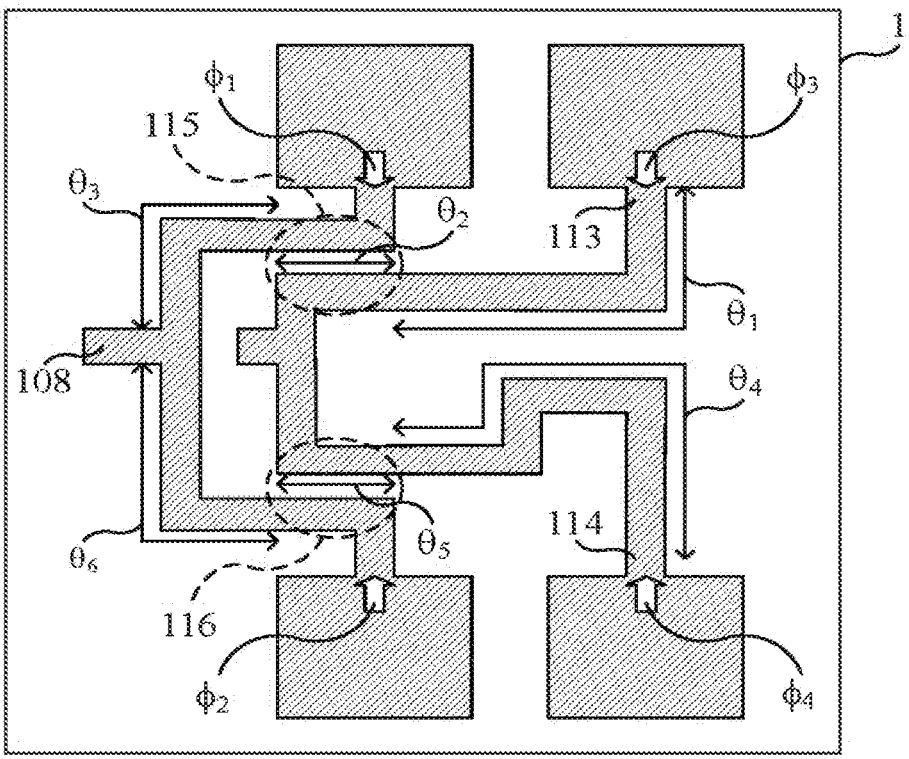
FIG. 4 illustrates electrical lengths of coupling portions in the feeder circuit of FIG. 1.

Referring back to FIG. 1, descriptions of the present invention continues. As in the conventional feeder circuit illustrated in FIG. 3, with respect to the feeder circuit illustrated in FIG. 1, consideration will be given with reference to FIG. 4 in the case where signals received by the radiating elements 3 are input from both the first end 111 of the first line 103 and the first end 112 of the fourth line 104 respectively, and where two signals, which are received by the radiating elements 4 and will be in-phase with each other in the second combiner 102, are input from the first end 113 of the third line 105 and the first end 114 of the fourth line 106 respectively.

Now, $\phi 1$ denotes a phase of the signal input to the first end 111 of the first line 103; $\phi 2$ denotes a phase of the signal input to the first end 112 of the second line 104; $\phi 3$ denotes a phase of the signal input to the first end 113 of the third line 105; and $\phi 4$ denotes a phase of the signal input to the first end 114 of the fourth line 106.

Figure 5:
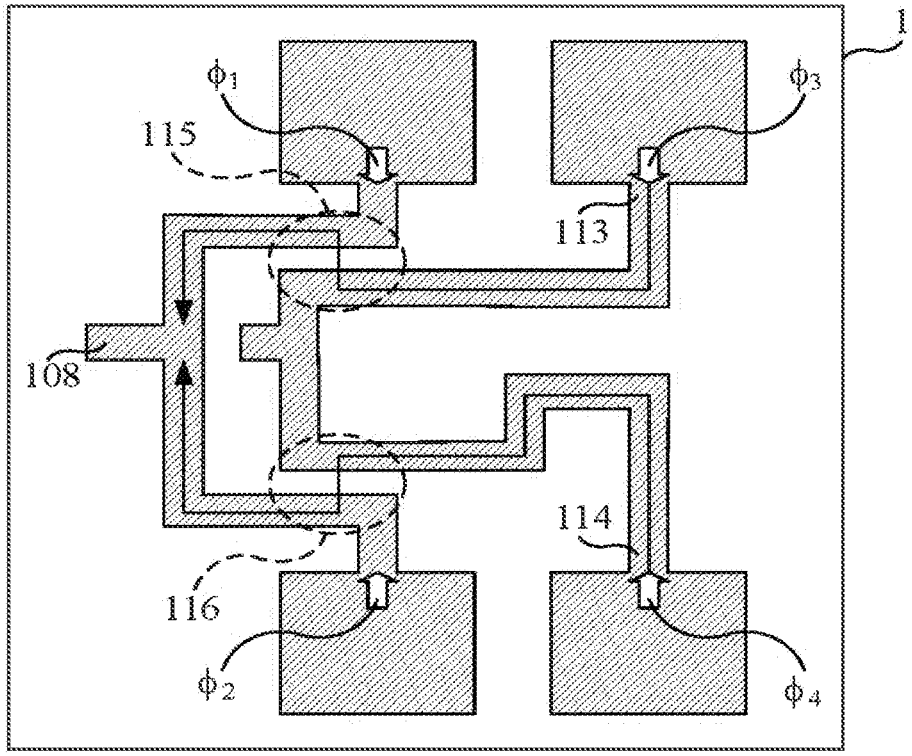
FIG. 5 illustrates electrical lengths of coupling portions in the feeder circuit of FIG. 1.

In the case of this embodiment, as illustrated in FIG. 5, part of the signal input to the first end 113 of the into the first line 103 in the first coupling portion 115, and then reaches the first combiner 101. Similarly, part of the signal input to the first end 114 of the fourth line 106 is electrically coupled to and propagates into the second line 104 in the second electrical coupling portion 116, and then reaches the first combiner 101.

Referring back to FIG. 4, the electrical lengths of paths relating to couplings will now be described. Specifically, $\theta 1$ denotes an electrical length of a path extending from the first end 113 to the first coupling portion 115 along the third line 105, $\theta 2$ denotes an electrical length of the first coupling portion 115, $\theta 3$ denotes an electrical length of a path extending from an end of the first coupling portion 115 to the output end 108 along the first coupling portion 115, $\theta 4$ denotes an electrical length of a path extending from the first end 114 to the second coupling portion 116 along the fourth line 106, $\theta 5$ denotes an electrical length of the second coupling portion 116, and $\theta 6$ denotes an electrical length of a path extending from an end of the coupling portion 116 to the output end 108 along the second coupling portion 116.

In this embodiment, the first coupling portion 115 is indispensable in layout design and has a fixed value.

In contrast, since the second coupling portion 116 has a degree of freedom in layout design, it is possible to change the electrical lengths $\theta 4$ to $\theta 6$ in layout design. To change the electrical lengths, for example, the length of the circumventing portion of the line can be changed.

Signals output toward the first combiner 101 from both the radiating element 4 on the upper side and the radiating element 4 on the lower side are 180 degrees out of phase with each other because these signals are coupled to the radiating elements 4 in the upper and lower directions opposite to each other, respectively.

Taking this into consideration, the electrical lengths $\theta 4$ to $\theta 6$ are determined to satisfy the equation as indicated below in a manner that allows the coupling amount in the first coupling portion 115 and the coupling amount in the second coupling portion 116 to be equal to each other.

The electrical lengths $\theta 4$ to $\theta 6$ may take various values by changing their line lengths. Each line may be a straight line or a curved line. The width of each line may be also changed.

$$\phi 3+\theta 1+\theta 2+\theta 3=\phi 4+\theta 4+\theta 5+\theta 6+(180\ \text{deg.}\times A), \quad (1)$$

where A is an odd number.

Specifically, the line extending from the end 114 to the second coupling portion 116, the coupling portion 116, and the line extending from the coupling portion 116 to the first combiner 101 are determined in a manner that allows the signal propagating toward the first combiner 101 from the radiating element 4 on the upper side to the output end 108 of the first combiner through the first coupling portion 115 and the signal propagating toward the first combiner 101 from the radiating element 4 on the lower side to the output end 108 of the first combiner 101 through the second coupling portion 116, to have the same amplitude and have opposite phases. This allows the signals received by the radiating elements 4 to be cancelled out in the first combiner 101, and thus allows the output end 108 to output only the signals received by the radiating elements 3. The reception pattern of the radiating elements 3 therefore keeps unchanged. Thus, even under the presence of the first coupling portion 115, a desired radiation pattern can be achieved.

Furthermore, in the embodiment, the effects caused by couplings between signal wires of lines for supplying power to the radiating elements are reduced, and also the radiating elements and the signal wires of lines can be arranged on the same face of the dielectric substrate. This allows for formation of an array antenna in the single layer of the dielectric substrate, and for its cost reduction.

The microstrip line and the patch antenna are used in the first embodiment, although no limitation thereto is intended. Alternatively, other types of lines and antennas, such as a strip line and a monopole antenna, may be used. In this regard, the coupling portion 116 can be designed in a manner that allows the signals entering the first combiner 101 through the first coupling portion 115 to be cancelled out.

In this embodiment, a configuration has been described where the second end 119 of the third line 105 and the second end 120 of the fourth line 106 are connected to the second combiner 102. Alternatively, with respect to only the third line 105, the second electrical coupling portion 116 may be formed by electrical coupling occurring between the second line 104 and the third line 105 which are arranged close to each other.

Also in this case, in layout design of the second coupling portion 116, we can let $\theta 4$ be an electrical length of a path extending from the first end 114 to the second coupling portion 116 along the fourth line 106, $\theta 5$ be an electrical length in coupling of the second coupling portion 116, and $\theta 6$ be an electrical length of a path extending from the coupling portion 116 to the output end 108. Then, the electrical lengths $\theta 4$ to $\theta 6$ can be determined in a manner that allows the coupling amount in the first coupling portion 115 and the coupling amount in the second coupling portion 116 to be equal to each other.

Second Embodiment

In the first embodiment, the feeder circuit including a combiner for in-phase combination has been described. In a second embodiment, a feeder circuit including a combiner for combination of opposite phases will be described. As an exemplary feeder circuit including a combiner for combination of opposite phases, a combiner will now be described which has its output end on a ground plane layer of a dielectric substrate.

Figure 6:
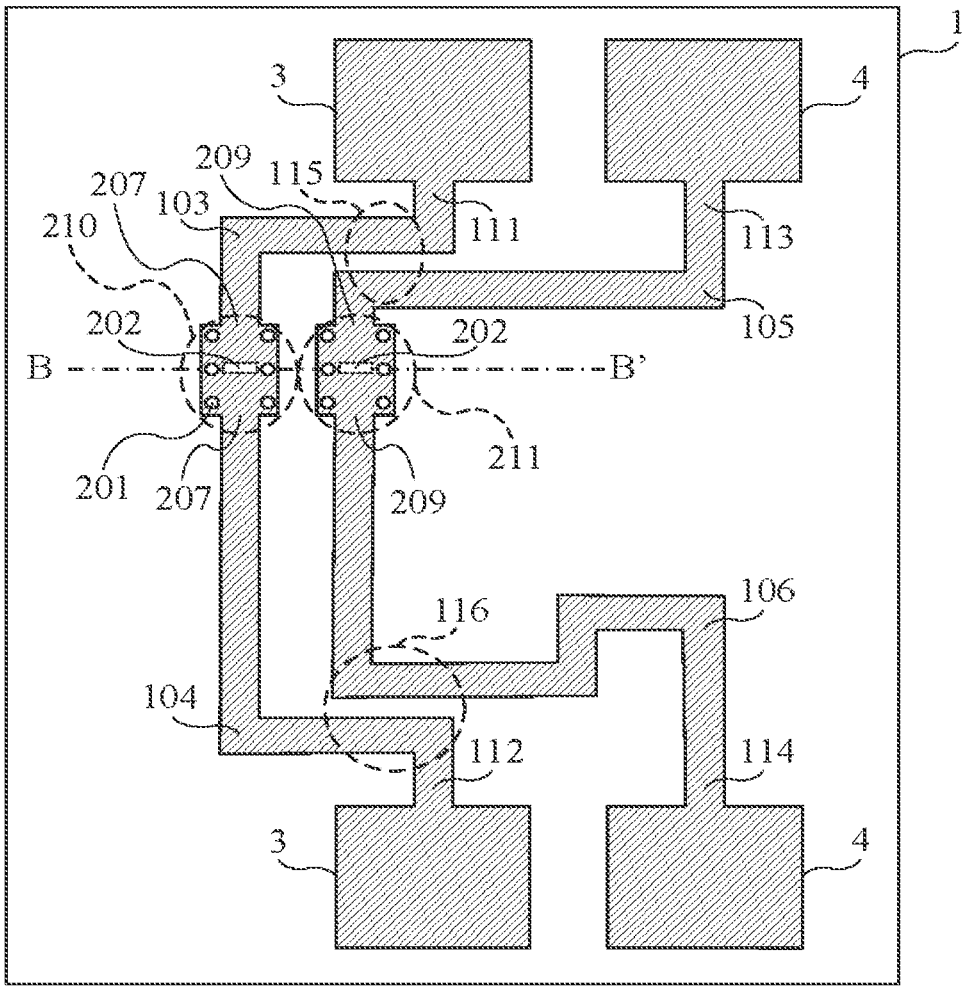
FIG. 6 is a top view of a feeder circuit according to a second embodiment.
Figure 7:
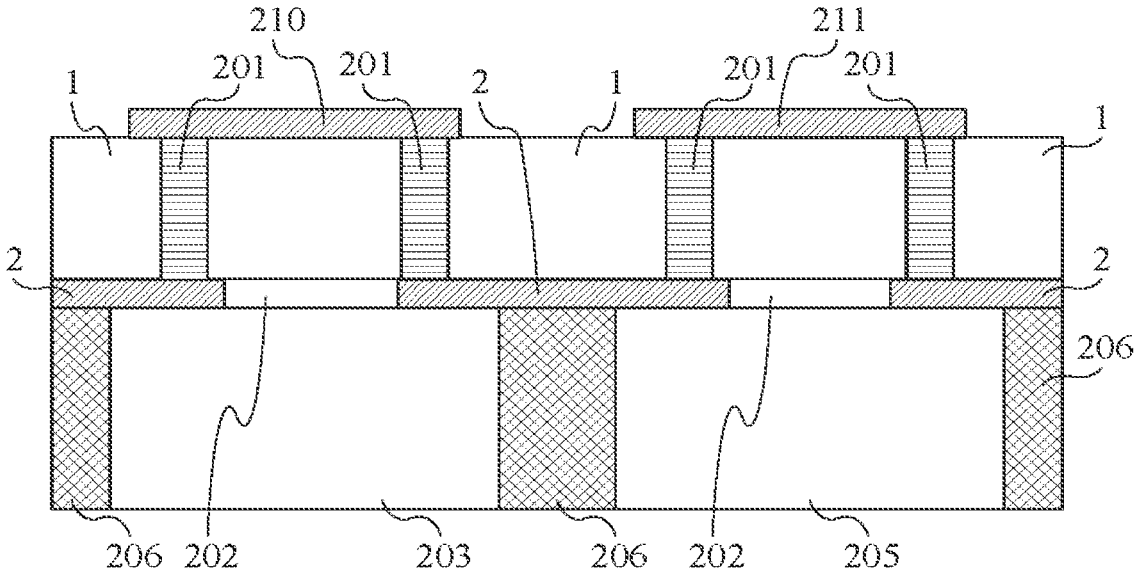
FIG. 7 is a cross-sectional view of the feeder circuit taken along the line B-B' in FIG. 5.

FIG. 6 illustrates a feeder circuit according to the second embodiment. FIG. 7 illustrates a cross-sectional view taken along the line B-B' in FIG. 6.

In FIGS. 6 and 7 illustrating the feeder circuit of this embodiment, the same reference signs as those in FIGS. 1 and 2 indicate the same or corresponding components as described with reference to FIGS. 1 and 2 as follows: a dielectric body 1, a ground plane layer 2, radiating elements 3, radiating elements 4, a first combiner 101, a second combiner 102, a first line 103, a second line 104, a third line 105, a fourth line 106, an input end 109 of a second combiner 102, a first end 111 of a first line 103, a first end 112 of a second line 104, a first end 113 of a third line 105, a first end 114 of a fourth line 106, a second end 117 of a first line 103, a second end 118 of a second line 104, a second end 119 of a third line 105, and a second end 120 of a fourth line 106.

In FIGS. 6 and 7, the reference sign "210" denotes a first combiner 210 of the second embodiment, "211" denotes a second combiner of the second embodiment, "207" denotes an input end of the first combiner 210, "209" denotes an input end of the second combiner 211, "201" denotes a connecting conductor, and "202" denotes a slot.

In FIG. 7, "203" denotes a waveguide's output end 203 of the first combiner 210, "205" denotes a waveguide's output end of the second combiner 211, and "206" denotes a metal block.

In this embodiment, the ground plane layer 2 is connected to the bottom face of the dielectric body 1 and various lines are connected to the upper face of the dielectric body 1.

The connecting conductor 201 connects the ground plane layer 2 provided on the bottom face of the dielectric body 1 to a pattern provided on the top face of the dielectric body 1.

The slot 202 is a hole passing completely through the ground plane layer 2. The hole may have any shape, such as a rectangular shape or an oval shape.

The waveguide's output end 203 of the first combiner 210 is provided on the ground plane layer 2 under the dielectric body 1 so as to cover the slot 202.

The waveguide's output end 205 of the second combiner 211 is provided on the ground plane layer 2 under the dielectric body 1 so as to cover the slot 202.

The metal block 206 insulates the waveguide's output end 203 of the first combiner 210 from the waveguide's output end 205 of the second combiner 211.

The first combiner 210 is a combiner for combination of opposite phases which is capable of combining signals input to the input ends 207 from both the first line 103 and the second line 104 without reflection loss when these signals have the same amplitude and have opposite phases, and of outputting a composite signal to the waveguide's output end 203.

The second combiner 211 is a combiner for combination of opposite phases which is capable of combining signals input to the input ends 209 from both the third line 105 and the fourth line 106 without reflection loss when these signals have the same amplitude and have opposite phases, and of outputting a composite signal to the waveguide's output end 205.

In the operations of the feeder circuit according to this embodiment, a signal input to the end 111 has a phase $\phi 1$; a signal input to the end 112 has a phase $\phi 2$; a signal input to the end 113 has a phase $\phi 3$; and a signal input to the end 114 has a phase $\phi 4$, like the first embodiment.

In taking into account the combiners 210 and 211 of the feeder circuit according to the second embodiment which are combiners for combination of opposite phases, like the directional coupler according to the first embodiment, the electrical lengths $\theta 4$ to $\theta 6$ are determined to satisfy the equation as indicated below in a manner that allows the coupling amount in the coupling portion 115 and the coupling amount in the coupling portion 116 to be equal to each other:

$$\phi 3+\theta 1+\theta 2+\theta 3=\phi 4+\theta 4+\theta 5+\theta 6+(360\ \text{deg.}\times B), \quad (2)$$

where B is an integer. In this regard, ($\phi 3+\theta 1+\theta 2+\theta 3$) and ($\phi 4+\theta 4+\theta 5+\theta 6$) are set to be in-phase with each other. By using 360 deg.×B, an advantageous effect of the present invention can be achieved.

In detail, the line extending from the end 114 to the second coupling portion 116, the coupling portion 116, and the line extending from the coupling portion 116 to the first combiner 210 are determined in a manner that allows the signal propagating toward the first combiner 210 from the radiating element 4 on the upper side to the output end 203 of the first combiner 210 through the first coupling portion 115 and the signal propagating toward the first combiner 210 from the radiating element 4 on the lower side to the output end 203 of the first combiner 210 through the second coupling portion 116, to have the same amplitude and be in-phase with each other. This allows the signals received by the radiating elements 4 to be cancelled out, and thus allows the output end 203 to output only the signals received by the radiating elements 3. The reception pattern of the radiating elements 3 therefore keeps unchanged. Thus, even under the presence of the first coupling portion 115, its antenna property is maintained.

In the second embodiment, the microstrip lines and the patch antennas are used, although no limitation thereto is intended. Alternatively, other types of lines and antennas, such as a strip line and a monopole antenna, may be also used. In this regard, the coupling portion 116 can be designed in a manner that allows the signals entering the combiner through the coupling portions to be cancelled out.

REFERENCE SIGNS LIST

1: dielectric body; 2: ground plane layer; 3: radiating element; 4: radiating element; 101: first combiner; 102: second combiner; 103: first line; 104: second line; 105: third line; 106: fourth line; 107: input end; 108: output end; 109: input end; 110: output end; 111: first end; 112: first end; 113: first end; 114: first end; 115: first coupling portion; 116: second coupling portion; 117: second end; 118: second end; 119: second end; 120: second end; 201: connecting conductor; 202: slot; 203: waveguide's output end of first combiner 210; 205: waveguide's output end of second combiner 211; 206: metal block; 207: input end of first combiner 210; 209: input end of second combiner 211; 210: combiner; and 211: combiner.

The invention claimed is:

1. A feeder circuit comprising:

a first line having a first end and a second end;

a second line having a first end and a second end;

a third line having a first end and a second end;

a first combiner connected to the second end of the first line and the second end of the second line, and configured to combine signals output from both the second end of the first line and the second end of the second line;

a first coupling portion configured to electrically couple a portion of the first line and a portion of the third line to each other; and a second coupling portion configured to electrically couple a portion of the second line and a portion of the third line to each other in a manner that allows a signal reaching the first combiner from the first end of the third line through the first coupling portion and a signal reaching the first combiner from the first end of the third line through the second coupling portion, to be cancelled out.

2. The feeder circuit according to claim 1, wherein:

the first combiner is a combiner for in-phase combination; and the second coupling portion is configured in a manner that allows a signal transmitted to the first combiner from the first end of the third line through the second coupling portion and a signal transmitted to the first combiner from the first end of the third line through the first coupling portion, to have a same amplitude and have opposite phases.

3. The feeder circuit according to claim 1, wherein:

the first combiner is a combiner for combination of opposite phases; and the second coupling portion is configured in a manner that allows a signal transmitted to the first combiner from the first end of the third line through the tirst coupling portion and a signal transmitted to the first combiner from the first end of the third line through the second coupling portion, to have a same amplitude and be in-phase with each other.

4. A feeder circuit comprising:

a first line having a first end and a second end;

a second line having a first end and a second end;

a third line having a first end and a second end;

a fourth line having a first end and a second end;

a first combiner connected to the second end of the first line and the second end of the second line, and configured to combine signals output from both the second end of the first line and the second end of the second line;

a first coupling portion configured to electrically couple a portion of the first line and a portion of the third line to each other;

a second combiner connected to the second end of the third line and the second end of the fourth line, and configured to combine signals output from both the second end of the third line and the second end of the fourth line; and a second coupling portion configured to electrically couple a portion of the second line and a portion of the fourth line to each other in a manner that allows a signal reaching the first combiner from the first end of the third line through the first coupling portion and a signal reaching the first combiner from the first end of the fourth line through the second coupling portion, to be cancelled out.

5. The feeder circuit according to claim 4, wherein:

the first combiner is a combiner for in-phase combination; and the second coupling portion is configured in a manner that allows a signal transmitted to the first combiner from the first end of the fourth line through the second coupling portion and a signal transmitted to the first combiner from the first end of the third line through the first coupling portion, to have a same amplitude and have opposite phases.

6. The feeder circuit according to claim 4, wherein:

the first combiner is a combiner for combination of opposite phases; and the second coupling portion is configured in a manner that allows a signal transmitted to the first combiner from the first end of the fourth line through the second coupling portion and a signal transmitted to the first combiner from the first end of the third line through the first coupling portion, to have a same amplitude and be in-phase with each other.

* * * * *